United States Patent [19]

Fisher, Jr.

[11] 4,381,822

[45] May 3, 1983

[54] LANDING NIPPLE

[75] Inventor: Ernest P. Fisher, Jr., Carrollton, Tex.

[73] Assignee: Otis Engineering Corporation, Dallas, Tex.

[21] Appl. No.: 262,472

[22] Filed: May 11, 1981

[51] Int. Cl.[3] ..... E21B 34/14

[52] U.S. Cl. ..... 166/326; 166/332

[58] Field of Search ..... 166/332, 333, 334, 325, 166/326; 137/614.11, 614.16; 251/349, 354

[56] References Cited

U.S. PATENT DOCUMENTS

| | | | |
|---|---|---|---|
| 1,639,743 | 8/1927 | Marscheider | 137/614.11 |
| 1,969,163 | 8/1934 | Stevenson | 137/614.11 |
| 4,134,452 | 1/1979 | Kingelin | 166/332 X |
| 4,201,364 | 5/1980 | Taylor | 166/332 X |
| 4,244,393 | 1/1981 | Lehtinen | 137/614.11 X |

FOREIGN PATENT DOCUMENTS

| | | | |
|---|---|---|---|
| 694713 | 8/1979 | U.S.S.R. | 137/614.11 |

*Primary Examiner*—Stephen J. Novosad
*Assistant Examiner*—Joseph Falk
*Attorney, Agent, or Firm*—Vinson & Elkins

[57] ABSTRACT

A landing nipple having a port through the wall thereof which is controlled by a valve carried by a non-circular ring which ring may be moved toward circular position by introduction of a sleeve-like member into the bore through the ring to unseat the valve.

8 Claims, 5 Drawing Figures

LANDING NIPPLE

This invention relates to landing nipples.

Landing nipples are frequently provided with a port for permitting flow between the interior and the exterior of the nipple. In many instances it is desirable to be able to control flow through this port. In producing petroleum wells, ported nipples have been used in the past with the port controlled by valves using elastomeric material to provide seals. For instance, a sleeve may be shifted to open and close a port with elastomeric material between the sleeve and the nipple body.

Landing nipples may be subjected to conditions in which elastomeric material is not suitable. In landing nipples for wells producing fluid of high acidic content the fluid attacks the elastomeric material and in time renders ineffective the ability of the elastomeric material to control flow through a port.

It is an object of this invention to provide a landing nipple with a valved port controlling flow through the side wall of the nipple without using seals of elastomeric material.

Another object is to provide a landing nipple having a valve controlled port for flow through the wall of the nipple in which all parts of the nipple are made of metallic material.

Another object is to provide a landing nipple with a valve controlled side wall port which is suitable for use in wells flowing acidic fluids.

Another object is to provide a landing nipple having a valve controlled side wall port in which no elastomeric materials are utilized and the valve acts as a check valve preventing flow except when positively held in unseated position.

Another object is to provide a landing nipple with a valve controlled side wall port in which debris is prevented from interfering with the operation of the valve controlling flow through the port.

Another object is to provide a landing nipple with a side wall valve controlled port in which the valve is controlled by bending of a ring-like member within the bore of the nipple and debris is prevented from interfering with bending of the ring-like member.

Another object is to provide a landing nipple with a valved port controlling flow through the side wall of the nipple in which the valve is controlled by a bendable ring within a groove in the landing nipple and debris is prevented from interfering with the bending of the ring by utilizing close tolerances between the ring and groove and a flowway is provided between the ring and groove which is controlled by a second valve member which opens and closes with opening and closing of the valve controlling the flow port.

Another object is to provide for pressure testing of control lines in wells producing high acidity fluids without running dummy valves.

Other objects, features and advantages of the invention will be apparent from the drawings, the specification and the claims.

In the drawings wherein an illustrative embodiment of this invention is shown and wherein like reference numerals indicate like parts;

Figure 1A:
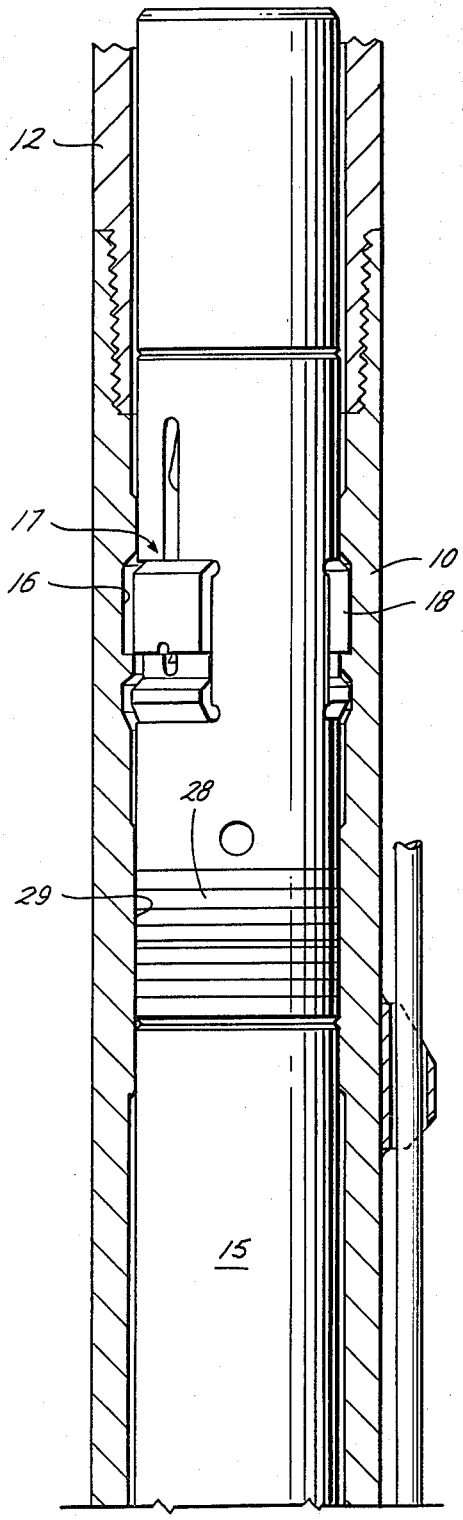
FIGS. 1A and 1B are continuation views showing in cross-section a portion of a well tubing having a landing nipple therein and showing in elevation a surface controlled subsurface safety valve and latch assembly for latching the valve in the landing nipple.
Figure 1B:
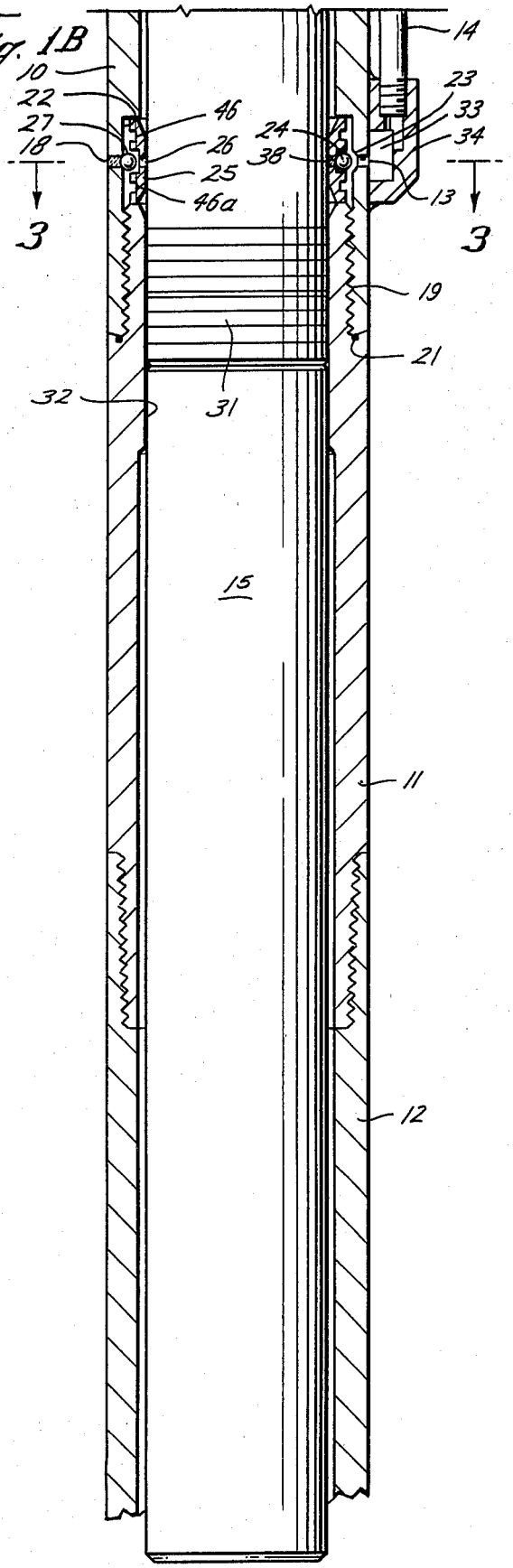

A landing nipple including an upper body section 10 and a lower body section 11 is made up in a conventional well tubing 12. The landing nipple may be utilized in any instance in which it is desired to control flow through a port in the nipple. The invention illustrated in the drawings is utilized to control flow through a port 13 in the nipple body which communicates with a control line 14 extending to the surface for controlling the operation of a subsurface safety valve shown in elevation at 15.

The upper body section 10 is provided with conventional landing grooves 16. Secured to the upper end of the valve 15 for latching it in position in the well is a conventional lock mandrel indicated generally at 17 having locking dogs 18 cooperable with grooves 16 for latching the assembly in the well.

The upper and lower nipple body sections 10 and 11 are threadedly interconnected by thread system 19. A suitable seal, preferably of metallic material, is provided at 21 to provide a leak proof threaded connection.

Immediately above the thread system 19 the body is provided with an internal groove 22 into which the port 13 opens.

A suitable valve seat is provided in port 13 at 23 and a valve member 24 carried by ring 25 controls flow through the port 13 by cooperation with the valve seat 23.

At a circumferentially spaced point from valve 24 the ring is provided with a flowway 26 providing at its radially outermost point a valve seat cooperable with a valve member 27 carried by the body to control flow between the annular groove 22 and the interior of the ring 25.

The ring 25 is made of elastic material which is capable of withstanding the corrosive action of fluids being produced in the well and when unstressed is preferably oval in configuration to maintain the first valve member 24 as well as the second valve member 27 seated on their respective seats to prevent flow through the ring and through the nipple port 13.

When the valve member 15 is introduced into the well and positioned such that its upper packing 28 engages the slick bore 29 in the upper body section 10 and the lower packing 31 engages the slick bore 32 in the lower body section 11, the valve 15 bends the ring 25 toward a circular configuration to unseat both valve members 24 and 27.

Preferably the ring 25 is formed from metallic material which will withstand corrosive fluids and, preferably, is formed from titanium alloy, a metal whose properties are admirably suited for withstanding corrosion and providing the necessary elasticity to permit movement of the valves 24 and 27 to full open position. Preferably, this movement is sufficient to provide a flowway past the valve members and their seats equal to the area of port 13.

If it is desired to provide a check valve preventing entry of well fluids into the control line 14, the valve 24 is positioned adjacent the largest diameter section of the ring 25 with the ring in unstressed condition. Thus, with the ring positioned in groove 22 the valve member provided by ball 24 will act as a check valve preventing entry of fluid into the control line 14 in addition to its function of acting as a valve preventing flow in any direction when in closed position. On the other hand, if it is desired to have the check valve function to prevent flow from the control line into the interior of the landing nipple, the valve would have a valve stem extending from the ring through the port 13 with a valve member in the cavity 33 of boss 34 which would engage a valve seat at the radially outermost section of the port 13 to provide a check valve function against flow from the control conduit 14 into the landing nipple. In this instance the valve would be located on a minor diameter size of ring 25.

The ring has a spline 35 on its exterior, and preferably at its major diameter dimension with the ring unstressed. This spline 35 has horizontal grooves 36 and 37 to permit fluid passing through the port 13 to readily move circumferentially about the ring. The ring is bored at 38 and counterbored at 39. The bore and counterbore provide for welding of the ball valve member 24 to the ring by the weld shown at 41. The spline 35 functions to prevent rotation of the ring and maintain the valve member 24 in alignment with its seat 23 by engaging vertical slot 42 in the upper body member 10.

In like manner, the ring is provided, preferably at a point diametrically opposed to the spline 35, with a suitable spline 43 having a bore 26 therethrough and a counterbore 45. The counterbore receives the second ball valve 27 which cooperates with the bore 26 to control flow from the groove 22 through the bore 26 to control flow between the interior and exterior of the ring.

The spline 43 is provided with horizontal grooves 46 and **46*a* to facilitate flow of fluid through port 26. The spline is also provided with a vertical groove 47 to permit the second check valve provided by ball 27 to be welded in the upper body 10 by weld 48 and the ring 25 thereafter moved into the groove past the ball 27. The spline 43 is received in the vertical groove 50 in body 10 to assist in alignment of ring 25**.

Figure 2:
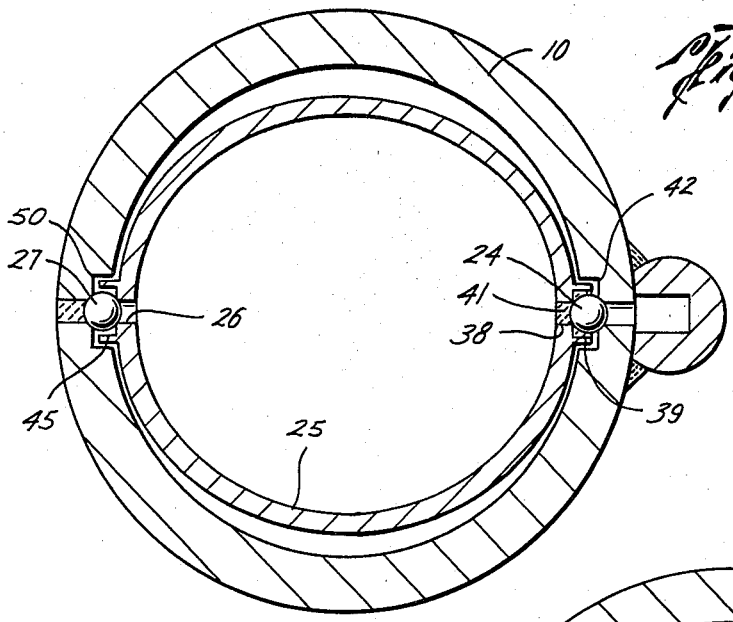
FIG. 2 is a view in cross-section taken along lines 3—3 of FIG. 1B with the valve omitted and illustrating the valve of this invention in closed position.

As shown in FIG. 2 with the ring assembled in the landing nipple and in a slightly stressed condition it is oval in shape. The ring is slightly more oval in shape than shown in FIG. 2 when in completely unstressed condition so that when assembled it is slightly stressed toward circular configuration to maintain the two valves 24 and 27 firmly seated.

It will be noted that the ring is provided with an internal chamfer 48 at its upper end and an internal chamfer 49 at its lower end. This prevents equipment hanging on the ring with the valves in closed position as equipment is run through the landing nipple.

Preferably, the ring is sized to close tolerance fit with the side walls of the groove 22 to inhibit the flow of trash between the ring and the landing nipple body to prevent any trash from interfering with normal operation of the ring.

Figure 3:
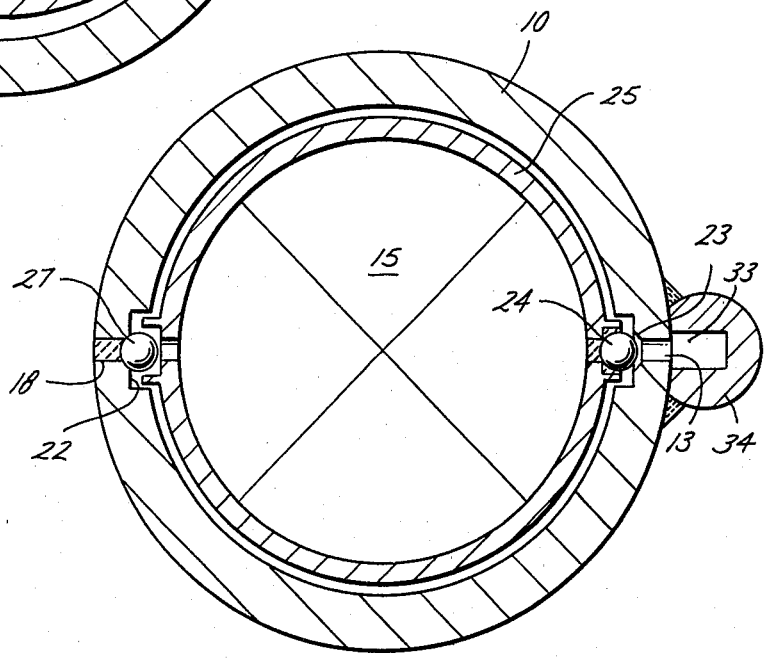
FIG. 3 is a view along the lines 3—3 of FIG. 1B showing the subsurface safety valve schematically and illustrating the manner in which it bends the ring of the landing nipple valve to unseat the landing nipple valve.
Figure 4:
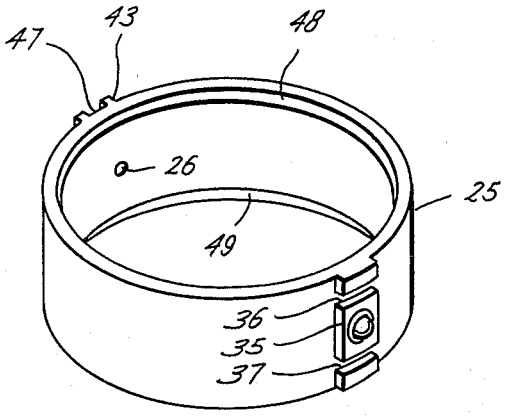
FIG. 4 is a perspective view of the ring and valve member for controlling flow through the landing nipple port.

As illustrated in FIG. 3, the introduction of a circular member into the ring, such as the subsurface safety valve 15, bends the ring toward a circular configuration to unseat valves 24 and 27. It will be appreciated that in bending the ring toward circular configuration the maximum diameter section of the ring is reduced in diameter and thus the valves could be positioned at any desired point along the arc of the ring which is reduced in diameter. Of course, the position of the valve member arcuately along the ring determines the amount of travel and preferably the valve members are positioned at the maximum diameter point on the ring. In the event that a check valve action is desired to prevent flow from the control line 14 into the nipple the valves would be located at the area of the ring which expands when the ring is bent to circular position to unseat the valves.

With the valves in unseated position as by the introduction of a subsurface safety valve, flow is permitted through the port 13 through the groove 22 and through port 26 to the interior of the nipple. Fluid is contained by the valve packing 28 and 31 in the conventional manner and is exerted on the control mechanism of the subsurface safety valve to operate the subsurface safety valve. It will be appreciated that in this instance the seals isolate well fluids from the area of the ring 25 to protect it against trash.

The valve members may be fabricated from any desired material. It is preferred that they be formed from tungsten alloy.

It will be appreciated that the second spline 43 and its associated valve member 27 and close tolerance between the body and ring are not necessary to the practice of this invention but they are preferred as the second spline assists in alignment and forming the ring to have a close tolerance with the side walls of groove 22 will restrict the entry of trash into the groove 22 and thus protect the ball 24 and its associated seat 23 from contamination by trash.

The material from which the ring is fabricated should be selected to be resistant to corrosion induced by fluids being produced by the well and should be selected to be bendable between its oval unstressed configuration and a substantially circular configuration without exceeding the elastic limits of the material so that it will always return to substantially its unstressed condition when the safety valve or other circular member is removed thus insuring that the ring will always return to valve seating position.

While splines 35 and 43 are preferred, other means could be utilized to maintain the valve member 24 in position to cooperate with the valve seat 23.

While the invention is particularly directed toward providing a valve assembly for wells having acidic production, it is apparent that the valve can be used in any well.

The foregoing disclosure and description of the invention is illustrative and explanatory thereof and various changes in the size, shape and materials, as well as in the details of the illustrated construction, may be made within the scope of the appended claims without departing from the spirit of the invention.

What is claimed is:

1. A landing nipple comprising, a tubular body having a bore therethrough, a port extending through the wall of the body, a valve seat in said port, an elastic ring in the bore through the body, a first valve member carried by the ring and cooperable with the valve seat to control flow through the port, means on said ring and body preventing relative rotation of said ring and body and maintaining their axes substantially parallel and said valve member positioned to cooperate with said seat, said ring when unstressed being non-circular in shape and dimensioned relative to the body to be slightly bent by the body with the valve member held against its seat by the elasticity of the ring, said ring bendable toward a circular configuration to unseat said valve member.

2. The landing nipple of claim 1 wherein a flowway having a seat therein extends through said ring and a second valve member is carried by said body and is seated and unseated in said flowway with seating and unseating of said first valve member to control flow through said flowway.

3. A landing nipple comprising, a tubular body having a bore therethrough, an internal annular groove in the body, a port between the groove and the exterior of the body, a valve seat in said port, an elastic ring in said groove, means preventing relative rotation of said ring and body, a first valve member on the ring cooperable with said valve seat to control flow through said port, said ring when unstressed being oval in shape with the valve member at approximately the maximum diameter of the ring, said ring dimensioned relative to the groove to be slightly bent by the body toward a circular configuration with the elasticity of the ring holding said valve member on said valve seat, said ring bendable toward a circular configuration to unseat said valve member without stressing said ring beyond its elastic limits.

4. The landing nipple of claim 3 wherein the inner surface of said ring is chamferred at the top and bottom of the ring.

5. The landing nipple of claim 3 wherein a cooperating spline and groove are provided on said body and ring to prevent relative rotation between the ring and body.

6. The landing nipple of claim 3 wherein a flowway having a seat therein extends through said ring and a second valve member is carried by said body and engages said flowway seat when the ring is in oval configuration to control flow through said flowway, and said ring has a close fit with said groove to restrict movement of solid material toward said port.

7. The landing nipple of claims 1, 2, 3, 4, 5 or 6 wherein the ring is formed of metal.

8. The landing nipple of claims 1, 2, 3, 4, 5 or 6 wherein the ring is formed of titanium alloy.

* * * * *